US005203796A

United States Patent [19]

Washam et al.

[11] Patent Number: 5,203,796

[45] Date of Patent: Apr. 20, 1993

[54] TWO STAGE V-GUTTER FUEL INJECTION MIXER

[75] Inventors: Roy M. Washam; Lewis B. Davis; Charles E. Steber, all of Schenectady, N.Y.

[73] Assignee: General Electric Company, Schenectady, N.Y.

[21] Appl. No.: 573,727

[22] Filed: Aug. 28, 1990

[51] Int. Cl.[5] ..... F02C 1/00; F02G 3/00

[52] U.S. Cl. ..... 60/737; 60/742; 60/746; 60/749

[58] Field of Search ..... 60/737, 738, 742, 743, 60/746, 747, 749, 39.463

[56] References Cited

U.S. PATENT DOCUMENTS

| | | | |
|---|---|---|---|
| 2,771,743 | 11/1956 | Lovesey | 60/749 |
| 2,948,117 | 8/1960 | Nerad et al. | 60/746 |
| 3,018,626 | 1/1962 | Chestek | 60/746 |
| 3,176,465 | 4/1965 | Colley, Jr. | 60/749 |
| 3,315,468 | 4/1967 | Vdoviak | 60/749 |
| 3,777,983 | 12/1973 | Hibbins | 60/742 |
| 4,726,192 | 2/1988 | Willis et al. | 60/737 |

FOREIGN PATENT DOCUMENTS 0319246 6/1989 European Pat. Off. .

*Primary Examiner*—Richard A. Betsch
*Assistant Examiner*—Howard R. Richman
*Attorney, Agent, or Firm*—Nixon & Vanderhye

[57] ABSTRACT

A gas turbine combustor is provided with a premixer in which an oxidant and fuel is mixed and caused to flow to the combustion zone past two or more arrays of convex members positioned transverse or canted to the flow. The convex members introduce turbulence and include a plurality of openings to introduce one or more additional fuels into the premixed oxidant and fuel flow. Parallel, annular and radial arrays, or combinations thereof, may be provided. The downstream array is V-shaped in cross section and provides flame holding capability while the upstream array principally provides additional mixing of fuel and oxidant.

52 Claims, 5 Drawing Sheets

FIG. 1
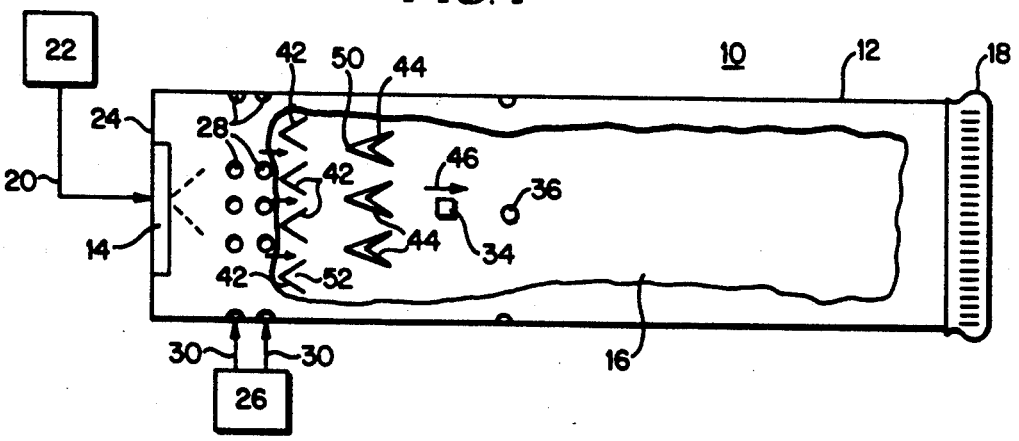
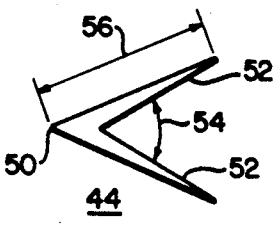
FIG. 2
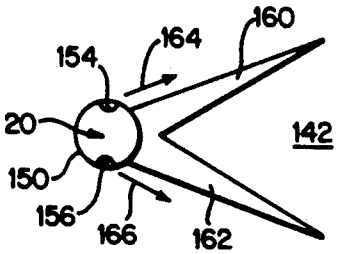
FIG. 3
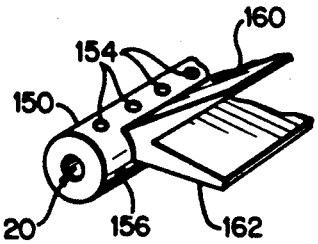
FIG. 4
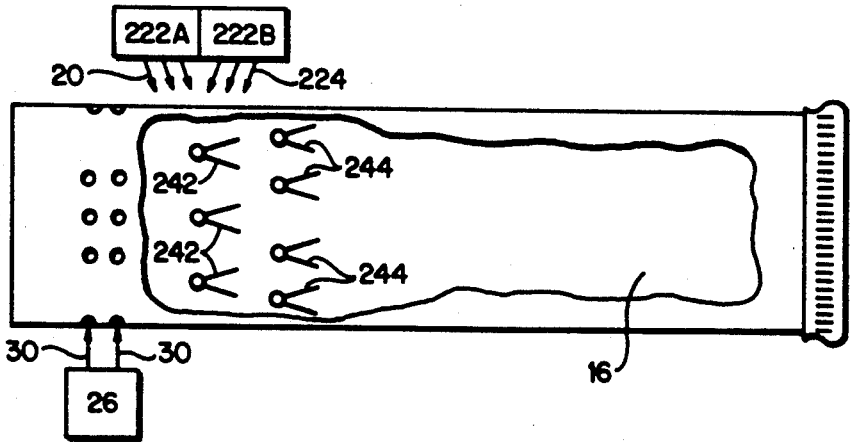
FIG. 5

FIG. 13
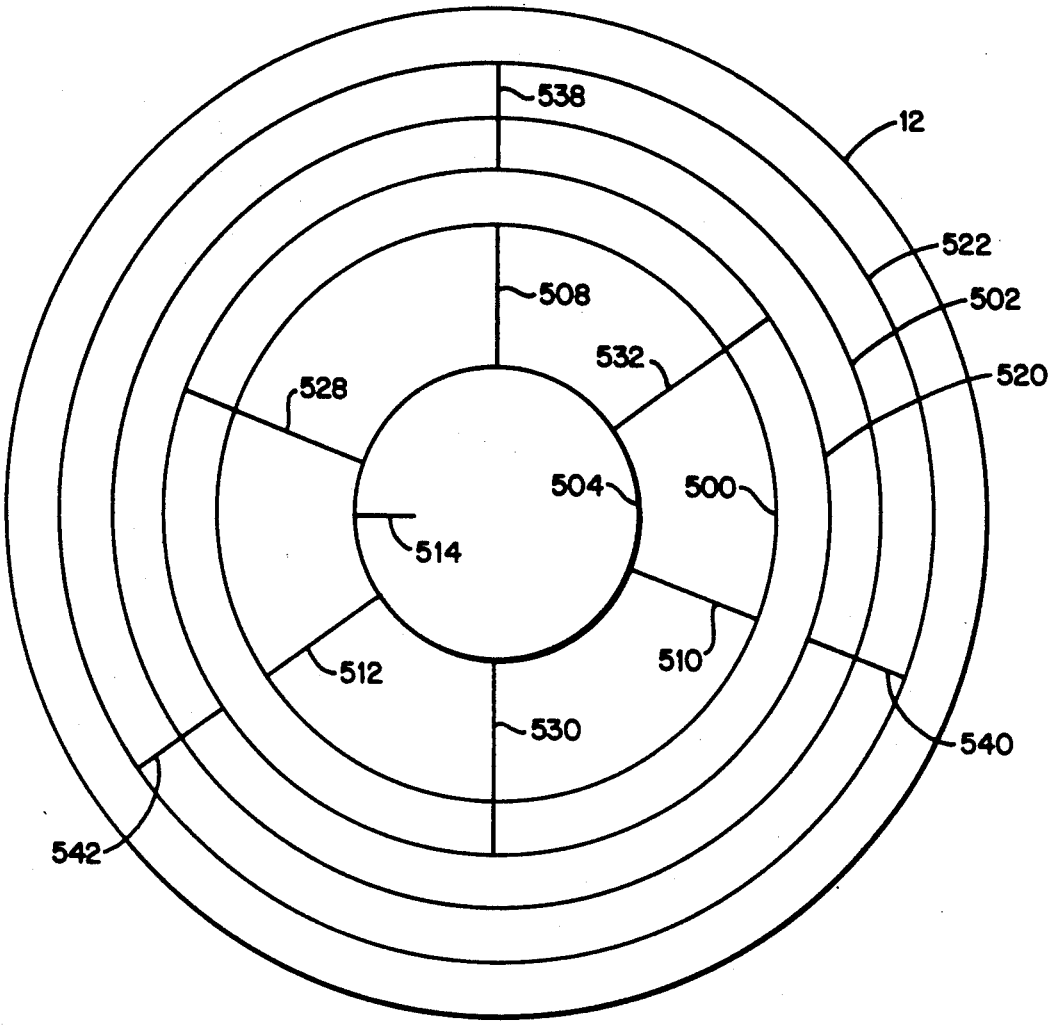
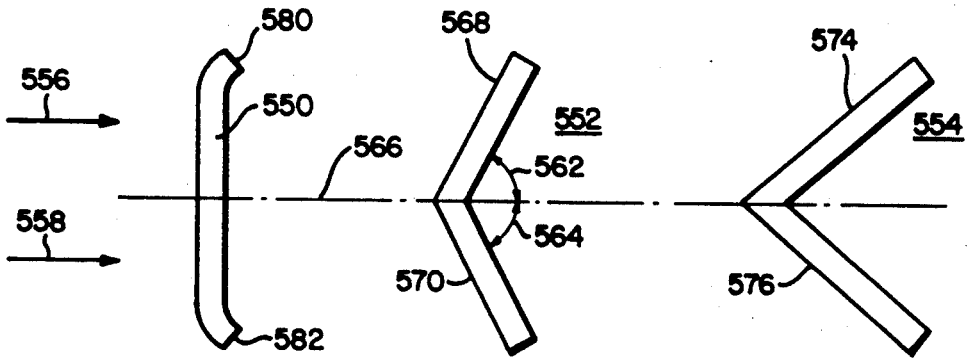
FIG. 14

TWO STAGE V-GUTTER FUEL INJECTION MIXER

BACKGROUND OF THE INVENTION

In recent years, governmental authorities and gas turbine manufacturers have become increasingly concerned with pollutant emissions. Gas turbine emission control regulations have been in effect since the early 1970's. Emission regulations have been issued, for example, by the State of California and the United States Environmental Protection Agency. The principal pollutants of concern have been oxides of nitrogen ($NO_x$) because such oxides are a precursor to air pollution. To comply with applicable regulations, water has been injected into the combustor flame zone to reduce flame temperature Reductions of up to 40 per cent in $NO_x$ resulted, along with low levels of carbon monoxide or unburned hydrocarbon emissions. However, more restrictive emission limitations have led to the requirement of an amount of water nearly equal to the fuel flow to be injected into the combustor flame zone, which in a natural gas fired machine impacts combustion system performance. It is, of course, very important that the combustor be able to burn stably and efficiently. In addition, it is generally a requirement that the combustor design be fired on either gas or oil fuels.

The operation of gas turbine combustors in which the fuel and oxidant are mixed and burned have become more complex in order to achieve the required, and desired, lower emissions. The modern dry low $NO_x$ two-stage premixed combustor is designed for use with natural gas fuel but is capable of operation on liquid fuel with atomizing air The second stage is commonly formed by a venturi, a converging/diverging section, which serves to accelerate the flow exiting the first stage, and which provides a recirculation zone on its downstream face to enhance flame stabilization. The purpose of accelerating the flow from the first stage is to prevent propagation of flame from the second stage into the first stage, so that the combustor can be operated in a premixed mode.

In a premixed mode for natural gas firing, the first stage serves to mix the fuel and air and to deliver a relatively uniform, lean, unburned fuel-air mixture to the second stage. The mixture is sufficiently lean that only a small amount of $NO_x$ is produced, but is also so lean that it will tend to not burn stably and efficiently. Therefore, a portion of the fuel is burned in the second stage nozzle to serve as a piloting source of flame to keep the premixed flow burning. In addition, the recirculation zone on the downstream side of the venturi serves to help stabilize the flame.

In a premixed gas turbine combustor it is desired to provide the following functions, while at the same time also maximizing fuel efficiency and minimizing pollutant emissions:

(1) provide a flow pattern conducive to the mixing of fuel and oxidant prior to the combustion zone, (2) inhibit the upstream propagation of flame through the fuel-oxidant stream (a phenomenon called flashback), (3) provide, on the downstream side, flow patterns conducive to flame stabilization, (4) aid in the atomization and vaporization process of liquid fuel, prior to the combustion process, (5) provide locations for fuel injection in the midst of an oxidant flow, and (6) aid in the process of crossfiring between combustors.

The above functions have been accomplished in the past by a plurality, up to three devices. It is desirable to be able to accomplish all of these functions in a single combustor.

In addition, with world fuel supplies and costs being uncertain, the ability to take advantage of a constantly changing fuel market has become an economic necessity. A gas turbine combustor should be designed to operate on a variety of fuels, including gaseous fuels such as natural gas or coal derived gas, and liquid fuels such as light distillate oils.

Various gas turbine combustor and related designs have been developed to achieve low emissions in gas turbine operation. See, for example, U.S. Pat. Nos. 3,958,413; 3,958,416; 3,946,553; 4,292,801 and 4,420,929. Also see the copending patent application, Ser. No. 07/474,394 filed Feb. 5, 1990, by W. T. Bechtel, M. Kuwata and R. M. Washam, and assigned to the same assignee as the present invention. Also see "Gas Turbine Combustion and Emissions" by L. B. Davis, General Electric GE Turbine Reference Library Publication GER-3568, of October, 1988. Also, V-shaped members interposed in the exhaust flow path within aircraft jet engine afterburners or augmenters have been used to provide flame stabilization. However, the processes used heretofore have not optimized all of the above-mentioned considerations and functions.

OBJECTS AND SUMMARY OF INVENTION

Accordingly, it is an object of the present invention to optimize the above considerations and functions in a gas turbine combustor.

It is another object of the present invention to combine the functions of a fuel injector, mixer, and flame stabilizer in one assembly.

It is a further object of the present invention to improve the operation of a gas turbine combustion system by combining the functions of the fuel injector, mixer and flame stabilizer.

It is a still further object of the present invention to improve the operation of gas turbine combustor fuel and air mixing, while providing a stable combustion system.

It is yet another object of the present invention to provide an improved, efficient, and reliable gas turbine combustor design which will operate with gas and liquid fuels, including distillate oil.

In accordance with a preferred embodiment of the present invention, a gas turbine combustor is provided with means to provide an oxidant flow and a fuel flow for premixing in one end region of the combustor. The fuel may be gas and/or liquid and the premixed fuel and oxidant mixture is subsequently directed past a plurality of arrays of convex members placed in the flow path, with their apexes pointed upstream toward the oxidant, and their trailing edges extending downstream toward the flame, to aid in fuel-oxidant atomization, vaporization and premixing, the prevention of flashback, and to provide locations for fuel injection in the midst of the oxidant flow.

The convex members may be V-shaped, and include openings to inject fuel into the flow, and may be arranged such that each apex of the second row is positioned downstream of the space between adjacent trailing edges of the preceding row. The arrays may be transverse to the flow or canted, and in various embodiments may extend annularly or radially, or both annularly and radially, about the axis of the combustor.

BRIEF DESCRIPTION OF DRAWINGS

FIG. 1 shows one embodiment of the present invention in a gas turbine combustor for use with a gas fuel and oxidant flow.

FIG. 2 shows an enlarged view of a convex-shaped gutter in FIG. 1.

FIGS. 3 and 4 show another embodiment of the present invention useful in injecting gas fuel into the premixed fuel and oxidant flow.

FIG. 5 shows still another embodiment of the present invention useful for injecting both liquid and gas fuels into the premixed fuel and oxidant flow

FIG. 13 is another alternate embodiment of the present invention illustrating the use of annular and radial gutters.

FIG. 14 illustrates cross sections of various convex members suitable for use as gutters.

Referring to FIG. 1, a gas turbine combustor 10 includes a cylindrical chamber 12, an axisymetric fuel nozzle or axisymetric pattern of fuel nozzles 14 in one end, and a combustion zone 16 in the region adjacent the downstream or exit end 18. Fuel, such as gas fuel 20, is supplied by fuel flow controller 22 to the fuel nozzle 14 which injects the fuel into the interior of the housing 12 through upstream end 24. The oxidant 30, such as air, supplied by the gas turbine compressor, or other source, 26 is introduced into the combustor 10 at elevated pressure, typically in the order of about 10–30 atmospheres through one or more air entry ports 28 arranged about the circumference of the chamber 12. The fuel mixed with the oxidant is ignited in a conventional manner such as by spark plug 34 for combustion in the combustion zone 16. Ports 36 located on the circumference of the chamber 12 in the combustion zone are for air addition to be used to optimize the burning process in terms of acoustics, stability, emissions, and exhaust temperature profile.

For descriptive purposes, one of many possible configurations is shown in FIG. 1. Two rows of convex-shaped gutters or bluff bodied members 42 and 44 are positioned transverse to the flow 46 of the gas and oxidant. As shown in FIG. 1 there are four spaced convex-shaped gutters 42 in the first row or array extending across a substantial cross-section portion of chamber 12 and three spaced convex-shaped gutters 44 downstream of, and substantially parallel to, the gutters 42 and extending across a substantial cross-section portion of the intermediate region of the chamber 12. It is noted that the apex of the gutters 44, such as apex 50, is positioned in the region between the adjacent legs of the two gutters 42 upstream from the apex 50. All apexes of the convex-shaped gutters 42 and 44 point upstream toward the upstream end 24 while the open ends, or trailing edges, such as 52 extend downstream toward the combustion zone 16

Figure 6:
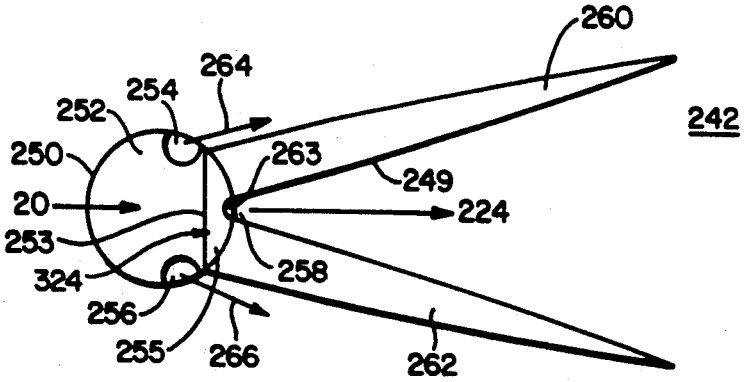
FIG. 6 shows an enlarged view of a convex-shaped gutter in FIG. 5.

As best shown in FIG. 2, the convex-shaped gutters 42 and 44 include trailing edges 52 extending outward from the apex 50 at an angle 54 in the order of 45 degrees, preferably from 20 to 70 degrees. The length 56 of the trailing edges in one embodiment is 2 inches and the length of the gutters transverse to the flow path is in the order of 5 inches in that one embodiment. This is essentially the transverse length of the interior of the chamber 12 at that point since the gutters 42 and 44 are welded in place or otherwise fastened where the ends contact the interior of the chamber 12.

In operation fuel 20 from the fuel flow controller 22 is injected by the fuel nozzle(s) 14 into the oxidant stream 30 from the gas turbine compressor 26. The convex-shaped gutters 42 and 4 cause flow disturbances which promote fuel-oxidant mixing. The degree of fuel and oxidant mixing is important in minimizing pollutants in the exhaust emission such as $NO_x$ (nitric oxide). This is of particular concern in a lean premixed gas turbine combustor operated to maximize fuel efficiency The acceleration of the premixing fluid around the convex-shaped gutters 42 and 44, and in particular the downstream gutters 44, also aid in preventing the propagation of the combustion process in the combustion zone 16 upstream into the premixing region around oxidant entry ports 28. In addition the separation and recirculation to the flow stream caused by the convex-shaped gutters 44 stabilizes the burning process. The flame holding ability of the present invention is of increased importance because of the relatively high susceptibility of lean premixed combustion flames to extinguish.

Referring next to FIGS. 3 and 4. FIGS. 3 and 4 show an arrangement to utilize the convex-shaped gutters such as 44 to introduce a gaseous fuel into the premixed fuel and oxidant flow. The gas fuel 20 is provided by a fuel flow controller such as 22 to each of the three convex-shaped gutters 142 which are positioned in the upstream array in place of convex-shaped gutters 42. As best shown in FIG. 4, the upstream gutters 142 include a generally cylindrical hollow manifold apex 150 which receives the gas fuel 20. However, there are a series of spaced openings 154 and 156 along the upstream convex-shaped gutter 142 as best shown in FIG 4. The openings 154 in manifold 150 are adjacent gutterwall or jaw 160, While the openings 156 in the manifold are adjacent the other gutterwall or jaw 162, to provide gas fuel flow 164 and 166 over the trailing edges of 160 and 162, respectively. Thus, the upstream convex-shaped gutters 142 are used as fuel introduction locations instead of having all of the fuel 20 introduced upstream of the gutters. A plurality of advantages are provided by this embodiment. The convex-shaped gutters 142 provide an additional fuel staging location which could be used in conjunction with fuel nozzle(s) 14. In addition, this embodiment provides a flexible way to spatially and uniformly distribute and mix the fuel in the oxidant flow. A still further advantage is that the structure tends to limit the resident time of the mixing process, which tends in turn to assist in preventing flashback, the upstream propagation of the flame in combustion zone 16 to the fuel oxidant flow or stream and in preventing autoignition, the spontaneous combustion of the flow upstream of the gutters 142.

Referring next to the embodiment shown in FIGS. 5 and 6, the fuel flow controller 222A provides the gas fuel 20 while the fuel flow controller 222B provides a liquid fuel 224 in a combined gas and liquid fuel system. The gas fuel 20 is introduced into the central region of the left or upstream portion 252 of the cylindrical manifold apex 250, which in this embodiment is divided into two parts by dividing wall 253 which is positioned across the cylindrical manifold apex and extends along the length of the cylindrical manifold apex. The downstream portion 255 of the cylindrical manifold 250 receives the liquid fuel 324 which is then injected into the oxidant-gas fuel stream through a series of spaced openings 258 in at least some of the upstream convex-shaped gutters extending along the juncture 263 of trailing edges 260 and 262.

Thus, the upstream portion 252 of manifold 250 allows the injection of gas fuel flow from 20 along the upstream portion 252 of the cylindrical manifold apex 250, and through spaced apertures 254 and 256 to inject the gas fuel flow 264 and 266 into the oxidant stream as in the embodiment of FIGS. 3 and 4 along with the advantages described above of such an arrangement. In addition, the downstream portion 255 of the manifold 250, which in essence is a second manifold, allows the injection of liquid fuel 224 into the oxidant and gas fuel stream through the openings 258. This provides an additional liquid fuel 224 capability to some, or all, of the upstream convex-shaped gutters 242. This additional capability enables the introduction of liquid fuel 224 that is spatially well distributed, and the convex-shaped gutters 242 tend to aid in atomization of the liquid fuel due to the shear flow around the upstream face 249 of the gutters. In addition, it is believed that thermally enhanced vaporization results from the impingement of the fuel flow 224 on the upstream side of the flame stabilizing convex-shaped gutters 244 which are positioned downstream from the injection of the liquid fuel 224 through openings 258 in the upstream gutters 242. These features assist in the prevaporization, and in the fuel-oxidant mixing that is important to the successful operation of a lean premixed combustor. Furthermore, as with the embodiment of FIGS. 2, 3, and 4, it is believed that the possibilities of flashback is limited by the introduction of the fuel into an accelerating flow that is provided into the burning or combustion zone 16.

Figure 7:
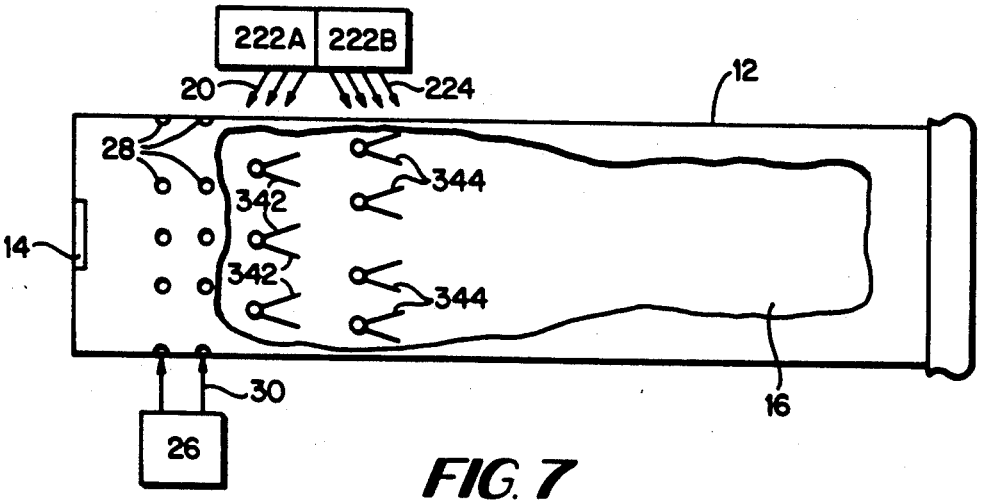
FIG. 7 shows yet another embodiment useful for the injection of both liquid and gas fuels into the combustor flow.
Figure 8:
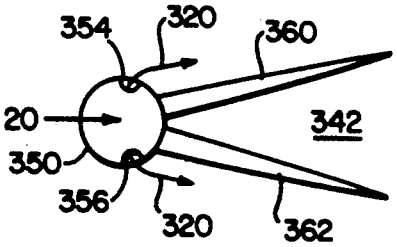
FIGS. 8 and 9 show enlarged views of the convex-shaped gutters of FIG. 7.
Figure 9:
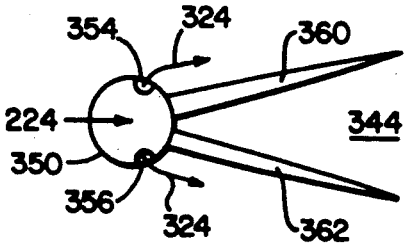

Both the upstream and downstream rows of convex-shaped gutters 242 and 244, respectively, may be used to introduce fuel as is shown in FIGS. 7, 8 and 9. Referring to FIGS. 7, 8 and 9, the gas fuel 20 provided by fuel flow controller 222A is provided to some, or all, of the manifolds 350 of the upstream convex-shaped gutters 342 to be injected through a series of spaced openings 354 and 356 in the manifolds adjacent the upstream ends of trailing edges 360 and 362 to provide gas fuel flow 320 over the outside of the trailing edges of the upstream gutters. Thus, the upstream convex-shaped gutters are used as gas fuel introduction locations instead of, or supplemental to, fuel 20 being introduced by fuel nozzle 14. The liquid fuel 224 provided by fuel flow controller 222B is provided to some, or all, of the manifolds 350 of the downstream convex-shaped gutters 344 to be injected through a series of spaced openings 354 and 356 in the manifolds adjacent to the upstream ends of trailing edges 360 and 362 to provide fuel over the outside of the trailing edges of the downstream gutters.

Thus, the downstream convex-shaped gutters are used as liquid fuel introduction locations The upstream gas fuel injection 320 and the downstream liquid fuel injection 324 mix with the oxidant flow 30 injected by the compressor 26. This further mitigates against the possibility of flashback by injecting the liquid fuel into a consistently converging flow that exists directly into the combustion zone 16.

Even if, in a particular design, flashback could possibly occur if the liquid fuel were injected from the upstream gutter 342 row, flashback may not occur with gas fuel in the upstream row due to the relatively low flame speed of some gas fuel mixtures. However, the upstream gas fuel location provides better mixing potential, and hence may be retained in some designs where the liquid fuel injection is moved to the downstream gutter 344 row.

While convex-shaped gutters have been shown by way of example, alternate embodiments of the invention can be provided with bluff-shaped bodies which are curved, or with a broad surface in, and transverse to, the flow stream at unequal angles to the flow stream, or an angle of greater than ninety degrees from the direction of flow as long as they provide adequate turbulence and mixing. Also, while two rows of gutters have been described, two or more rows, interposed between the oxidant flow and the flame of the combustor may be provided.

The geometry of the arrays is relatively unlimited to enable optimized operation of the fuel injector. The arrays may be parallel members extending transverse to the fuel-oxidant flow as shown in FIGS. 1, 5, and 7. Alternately, the arrays may extend radially outward from a central manifold which may be of an annular configuration as shown schematically in FIG. 10.

Figure 10:
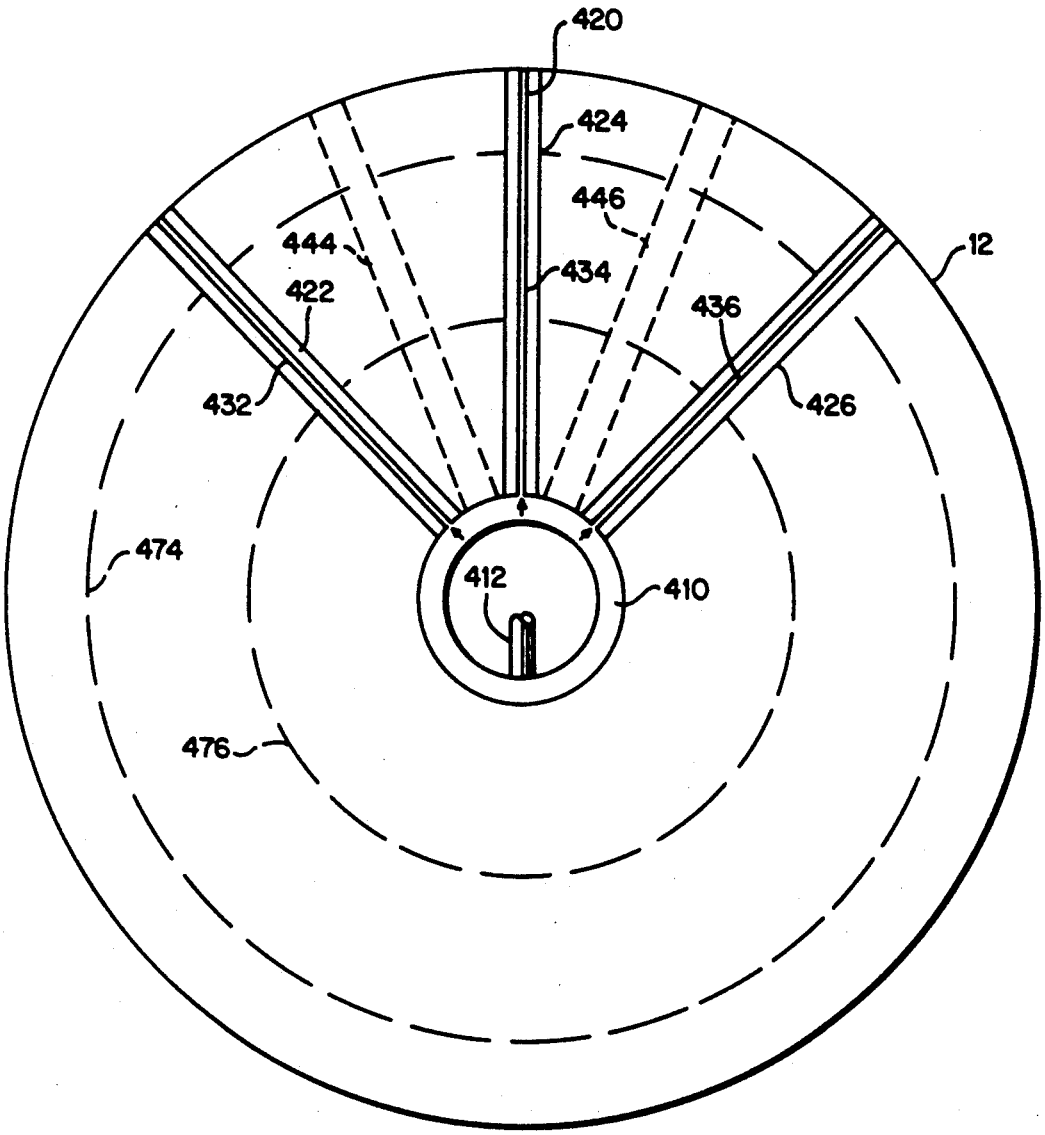
FIG. 10 is an alternate embodiment of the present invention illustrating the use of radial gutters.

FIG. 10 illustrates radial placement of gutters within the cylindrical chamber 12 of a gas turbine combustor 10 in which the combustor flow is into the Figure Fuel is fed to the annular manifold or fuel inlet 410 from fuel supply line 412. Annular manifold 410 supplies fuel to a plurality of radial gutters such as 422, 424, and 426 through the apex 432, 434, and 436 of each, respectively. The fuel exits the radial gutters 422, 424, and 426 through holes spaced along the gutters in a manner as illustrated, for example, in FIG. 5. The angular spacing, dimensions, and radial lengths of the radial gutters 422, 424, and 426 may be varied to meet the fuel flow and mixing characteristics required for optimum operation. Also, additional radial gutters may be provided on the second stage array. Two such additional radial gutters 444 and 446 are shown dotted and angularly positioned between radial gutter pairs 422, 424 and 424, 426, respectively. In practice, the radial gutters such as 422, 424, 426, 444 and 446 would be positioned completely around the axis of the gas turbine combustor 10 and would be spaced at equal angles about annular manifold 410. In a typical combustor, the number of radial gutters in a row may vary from 6 to 18. The downstream array of radial gutters would normally be equal in number to the upstream array, or a multiple or submultiple thereof. That is, the ratio of the number of gutters in a flowpath in the two arrays will tend to be a whole number.

Still further, the radial gutters such as 422, 424, 426, 444, and 446 may be canted, that is their ends closest the center of the gas turbine combustor 10 and the first annular manifold 410 are positioned further upstream than the ends remote from the center of the gas turbine combustor. Both gutter arrays may be canted, although one may extend perpendicular to the axis of the combustor. Such arrangements are shown schematically in FIGS. 11 and 12.

Figure 11:
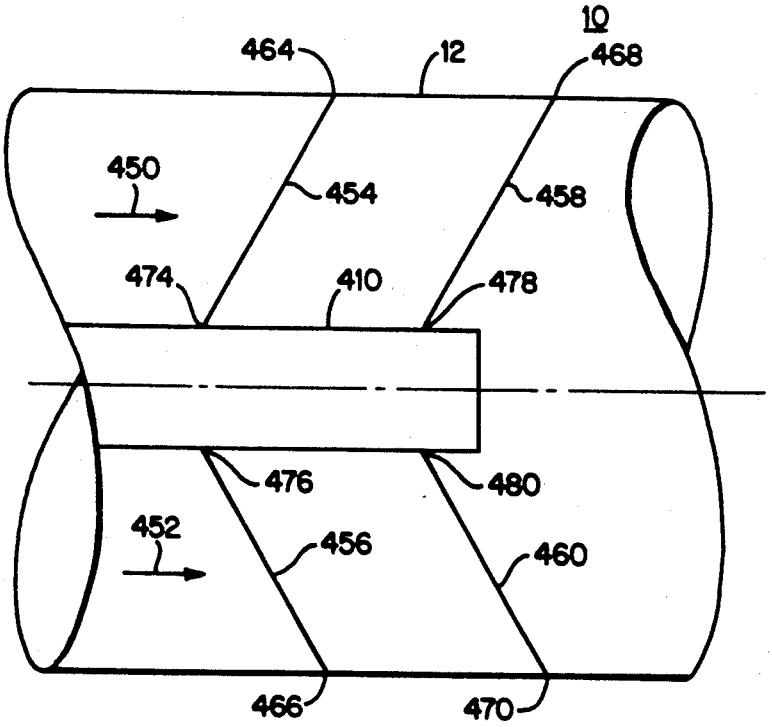
FIGS. 11 and 12 are variations of the embodiment shown in FIG. 10.
Figure 12:
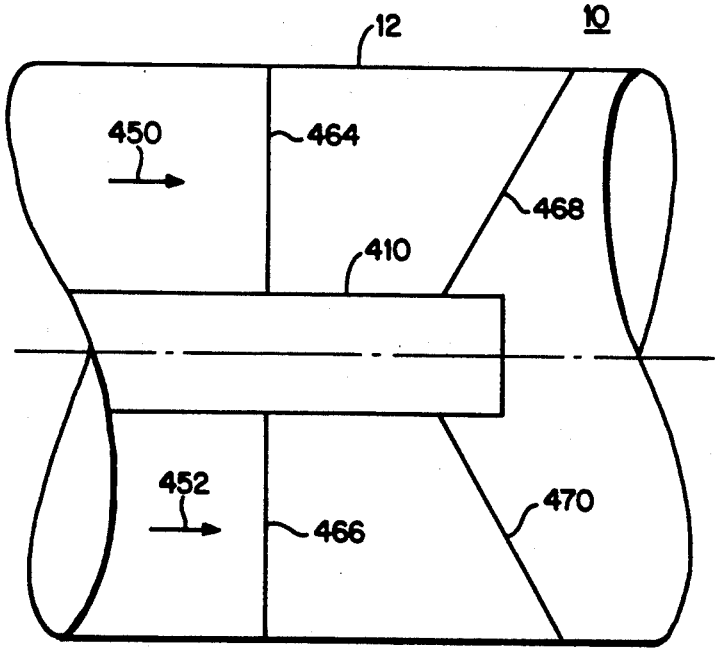

Referring first to FIG. 11, the arrows 450 and 452 point in the downstream direction of, and the flow within, the cylindrical chamber 12 of the gas turbine combustor 10. The radial gutters 454 and 456 of the upstream array and 458 and 460 of the downstream array are canted such that their outer ends 464 and 466; and 468 and 470, respectively, are further downstream than their inner ends 474 and 476; and 478 and 480, respectively. In FIG. 12 the upstream array, including radial gutters 464 and 466, are convex members substantially perpendicular to the flow shown by arrows 450 and 452, while the downstream array, including radial gutters 468 and 470, are canted.

FIG. 13 shows an annular array version of the present invention in schematic form. Referring to FIG. 13, the annular gutters 500 and 502 constituting the upstream array are concentric about the annular manifold 504. The annular gutter 500 is supported by radial support arms 508, 510, and 512, one or more of which may be hollow and serve to carry fuel to the annular gutter 500. Fuel is supplied to the annular manifold 504 from fuel supply pipe 514 positioned within the annular manifold The radial support arms 508, 510, and 512 may be configured as gutters to provide a combination of radial and annular gutters. Interspersed behind and between the upstream array 500, 502 is the downstream array of annular gutters 520 and 522. All of the annular gutters are supported by radial arms which may extend from the annular manifold 504 or from the inner annular gutter of that array. That is, annular gutter 502 may be supported on radial arms or gutters extending from annular gutter 500, and annular gutter 522 may be supported on radial arms or gutters extending from annular gutter 520. Such an arrangement is illustrated by the radial arms 528, 530, and 532 which support the inner annular gutter 520 of the downstream array 520, 522; and the radial arms 538, 540, and 542 which extend between annular gutters 520 and 522 of the downstream annular gutter array 520, 522. Similarly, the radial arms 538, 540, and 542 may be formed in the shape of gutters and one or more of them may carry fuel from annular gutter 520 to annular gutter 522 if fuel is injected through the downstream annular gutter array 520, 522.

FIG. 14 illustrates some of the various convex bodies suitable for use with the present invention. The convex member 550 is substantially planar, with slight rounding toward the downstream ends. The arrows 556 and 558 point downstream in the direction of the fuel-oxidant flow from the initial premix area of the combustor chamber 12. The convex member 552 assumes more of a V-shape with the angles 562 and 564 between the trailing edges 568 and 570 with an axial line 566 being greater than 45 degrees, while the convex member 554 includes trailing edges 574 and 576 at an angle of less than 45 degrees with axial line 566. In applications of the present invention, the convex members used in the upstream or mixing array may be flatter than those in the downstream or flame holding array. Convex members, having a cross section more like 550 and 552, may be better suited for the upstream fuel injection and mixing array, while convex members having a cross section more like 552 and 554 may be better suited to the downstream flame holding array. The exact angles of the convex-shaped members 552 and 554 will in a particular application be determined by the geometry of the combustor and the fuels used in the particular application. In order to obtain suitable backflow, turbulence, and suitable mixing, particularly in the upstream mixing array, the trailing edges, such as 568 and 570, should terminate in ends 580 and 582, respectively, with sharp, not rounded, corners.

It is thus to be appreciated that tremendously increased design variables for a gas turbine fuel injector are made possible through variation of the gutter size and cross section, along with variations of the angle of the trailing edges relative to the fuel-oxidant flow in the combustor. Also, it is possible to vary the arrays of gutters, whether parallel, annular, or radial, and the number of gutters in each array, along with variations in the angle of the arrays relative to the fuel-oxidant flow. They may be transverse to the flow or canted. One stage may be transverse and the other stage canted. The number of possible variations and combinations is thus very large providing great breadth and flexibility in designing and controlling the fuel-oxidant mixing and flow, while at the same time providing flame stabilization and optimum performance and efficiency with due regard to minimizing undesired emissions such as $NO_x$ (nitric oxide).

Other possible array configurations include annular gutters instead of radial gutters, or a combination of the two. One possible annular array combined with a radial array is shown by the dotted lines 474 and 476 in FIG. 10 in which the annular array gutters 474 and 476 are combined with the radial array including radial gutters 422, 424 and 426. Also, the diameter of the annular manifold such as 410 in FIG. 10, and 504 in FIG. 13, may be varied in either, or both of, the upstream and downstream arrays.

In some applications it may be desirable to have the first array not only blunter, but also smaller. The trailing edges of the first array are preferably squared, or at least present corners which are not rounded to provide trailing edges which trip the flow past the gutters. The resultant recirculation, or back flow, is desirable for mixing, but the recirculation zone, or wake, from the upstream array, should not extend beyond the end of the second array to discourage backflow drawing or pushing the flame upstream. The downstream array should generate an adequate fuel-oxidant flow speed which is greater than the flame speed. In many of the configurations described above, the flow of fuel-oxidant takes an S-shaped path which further isolates the upstream fuel-oxidant from the flame.

In a two-stage array of gutters, the fuel mixing is preferably done in the upstream array, remote from the flame such that the upstream array primarily acts as fuel-oxidant mixers which add to, and further mix, the premixed fuel-oxidant flowing past the upstream arrays. The previously premixed fuel-oxidant is thus further mixed, and further fuel may be added providing additional controlled premixing. The downstream array primarily provides flame stabilization action accelerating the flow and damping out any tendency of the flame to be pushed back upstream, although further fuel may also be added and mixed in the downstream array. As such, the upstream fuel injection and mixing arrays may utilize flattened, or flatter, convex member configurations. They may, for example, be generally rounded rather than convex-shaped. On the other hand, the downstream arrays are designed to minimize or prevent reverse flow and would normally be more curved, or convex-shaped, with a smaller central angle.

The downstream gutter array can provide a number of advantages over the use of a venturi to accelerate the flow to prevent flashback. The spacing, size, and number of gutters, and gutter geometry are variables which provide greatly increased design flexibility through the ability to vary and control the size of the flow wakes created, the number of flow wakes, and the spacing between the wakes. This design flexibility also facilitates the modeling and subsequent testing of designs to optimize the fuel injection design. The improved coherent radial wake from the combustor centerline to the combustor wall is advantageous as is the better flame stabilization flow pattern which results. In addition, the downstream array provides a third stage where additional fuel injection may be applied.

In one embodiment the angle of the trailing edges (such as 260 and 262 in FIG. 6) were each 37 degrees to the central axis. The wake generated by such a gutter is approximately 4 times the width of the trailing edges. On the other hand, a substantially planar convex member positioned perpendicular to the fuel-oxidant flow will generate a wake which approximates the width of the planar convex member. Thus, the angle of the trailing edges can be adjusted or designed to provide an acceptable wake within the geometric confines of the cylindrical chamber 12 of the gas turbine combustor 10. Accordingly, it is possible and it may be desirable to design a large length to width ratio of the wake for flame holding, while providing a shorter wake for mixing, leading to a combustor design in which the angle of the trailing edges of the downstream array is made less than that of the upstream array.

The design considerations of the particular configuration of convex-shaped gutters will thus depend on the fuels to be used, and on other design considerations in order to optimize safety and reliability of operation, while also factoring in fuel efficiency and emission considerations. The various embodiments of the present invention, shown by way of example, are intended to enhance fuel vaporization, fuel staging, fuel-air mixing, and flame stabilization in a gas turbine combustor although the present invention could be applied to other mixing and/or combustion systems.

Thus, while the present invention has been described through preferred embodiments, such embodiments are provided by way of example only. Numerous variations, changes and substitutions, including those discussed above, will occur to those skilled in the art without departing from the scope of the present invention and following claims.

What we claim is:

1. In a gas turbine combustor for mixing and combusting fuel and an oxidant comprising:

an enclosure for the introduction and mixing of the fuel and oxidant in an upstream end region thereof, and for combustion of the mixture of said fuel and oxidant in a downstream end region thereof;

two or more rows of convex-shaped members in the upstream end of said enclosure extending transverse to the mixture flow from the upstream end to the downstream end regions, each row having a plurality of spaced convex-shaped members;

said convex-shaped members each including an apex connecting a pair of trailing edges;

the apex of each of said convex-shaped members being pointed toward the upstream end of said enclosure, and said trailing edges of said convex-shaped members extending outwardly from said apex toward the downstream end of said enclosure;

means to inject the oxidant into said upstream end region to cause an oxidant flow toward the downstream combustion end region; and means to inject said fuel into said upstream end region for mixing with said oxidant flow;

said convex-shaped members being interposed in, and extending transverse to, the path of said mixture flow;

a first row of said convex-shaped members located to assist in said mixing of said fuel and said oxidant, and a second row of said convex-shaped members located downstream of said first row of said convex-shaped members to assist in separating an area of mixing from said combustion end region, and wherein the apexes of at least some of said second downstream row of convex-shaped members are positioned axially behind and pointing toward openings between adjacent trailing edges of said first row of convex-shaped members.

2. The gas turbine combustor of claim 1 wherein said first row of convex-shaped members and said second row of convex-shaped members are substantially parallel.

3. The gas turbine combustor of claim 1 wherein said fuel injecting means comprises one or more fuel nozzles positioned within said combustor upstream from said oxidant injecting means.

4. The gas turbine combustor of claim 1 wherein said trailing edges of said convex-shaped members are at an angle to said mixture flow with the angle between the trailing edges of said second row of convex-shaped members being less than the angle between the trailing edges of said first row of convex-shaped members.

5. The gas turbine combustor of claim 1 wherein at least one row of convex-shaped members are V-shaped in cross section.

6. The gas turbine combustor of claim 5 wherein said first and second rows of convex-shaped members are V-shaped in cross section.

7. The gas turbine combustor of claim 1 wherein at least one row of said convex-shaped members is canted with portions remote from the axis of said combustor being further downstream than portions closer to said axis.

8. The gas turbine combustor of claim 7 wherein both said first row and said second row of convex-shaped members are canted.

9. The gas turbine combustor of claim 1 wherein said means to inject fuel includes means to inject gas fuel into said mixture flow through first openings located near the apexes of at least some of said convex-shaped members, and means to inject liquid fuel into said mixture flow through second openings located near the apexes of at least some of said convex-shaped members.

10. The gas turbine combustor of claim 9 wherein the apexes of the convex-shaped members which are adapted to inject gas fuel and liquid fuel into said flow are substantially elongated manifolds.

11. The gas turbine combustor of claim 10 wherein a first of said rows of convex-shaped members is located upstream of a second one of said rows of convex-shaped members, and said gas fuel is connected to at least some of the first row of convex-shaped members.

12. The gas turbine combustor of claim 11 wherein said liquid fuel is connected to some of said second row of convex-shaped members for injection into said mixture flow downstream from the injection of said gas fuel.

13. The gas turbine combustor of claim 1 wherein openings in at least some of said convex-shaped members provide means to inject at least some of said fuel into said oxidant flow.

14. The gas turbine combustor of claim 13 wherein said openings are spaced along at least some of said convex-shaped members such that the fuel injected through said openings is mixed with said mixture flow.

15. The gas turbine combustor of claim 13 wherein said openings are located near said apex of some of said convex-shaped members.

16. The gas turbine combustor of claim 13 wherein some of said openings are connected to inject gas fuel into said mixture flow near the apexes of some of said convex-shaped members, and other of said openings are connected to inject liquid fuel into said oxidant flow near the apexes of other of said convex-shaped members.

17. The gas turbine combustor of claim 16 wherein said means to inject at least some fuel into said mixture flow includes substantially elongated manifolds at the apexes of said convex-shaped members and at least one fuel opening to admit fuel into each said manifold to connect to said openings in at least some of said convex-shaped members.

18. In a gas turbine combustor for mixing and combusting fuel and an oxidant comprising:

an enclosure for the introduction and mixing of the fuel and oxidant in an upstream end region thereof, and for combustion of the mixture of said fuel and oxidant in a downstream end region thereof;

two or more rows of convex-shaped members in the upstream end of said enclosure extending transverse to the mixture flow from the upstream end to the downstream end regions;

said convex-shaped members each including an apex connecting a pair of trailing edges;

the apex of each of said convex-shaped members being pointed toward the upstream end of said enclosure, and said trailing edges of said convex-shaped members extending outwardly from said apex toward the downstream end of said enclosure;

means to inject the oxidant into said upstream end region to cause an oxidant flow toward the downstream combustion end region; and means to inject said fuel into said upstream end region for mixing with said oxidant flow;

said convex-shaped members being interposed in, and extending transverse to, the path of said mixture flow;

a first row of said convex-shaped members located to assist in said mixing of said fuel and said oxidant, and a second row of said convex-shaped members located to assist in separating an area of mixing from said combustion end region;

wherein a first manifold extends along the apexes of one or more of said convex-shaped members to connect a first group of openings spaced along the one or more of said convex-shaped members, a first inlet adapted to be connected to a source of gas fuel to flow through said first manifold to the first group of spaced openings and a second manifold extending adjacent said first manifold to connect a second group of openings spaced along the one or more of said convex-shaped members, and a second inlet adapted to be connected to a source of liquid fuel to flow through said second manifold to the second group of spaced openings.

19. The gas turbine combustor of claim 18 wherein said first and second manifolds are on said first row of convex-shaped members.

20. The gas turbine combustor of claim 18 wherein there are at least two rows of spaced openings extending across said first manifold with one of the rows of openings located adjacent the outer surface of one of the trailing edges to inject said gas fuel to flow over said outer surface of said one of said trailing edges, and another of the rows of openings located adjacent the outer surface of the other of the trailing edges to inject said gas fuel to flow over said outer surface of said other of said trailing edges.

21. The gas turbine combustor of claim 20 wherein said first and second manifolds form a tube of a substantially circular cross section having a longitudinal wall dividing the tube into two manifolds of substantially semi-circular cross section.

22. The gas turbine combustor of claim 18 wherein said first manifold is positioned upstream from said second manifold.

23. The gas turbine combustor of claim 22 wherein said second group of spaced openings are positioned along the apexes between the trailing edges of the one or more convex-shaped members on which they are positioned to inject liquid fuel into the region within and between those trailing edges.

24. The gas turbine combustor of claim 23 wherein said first group of spaced openings are positioned along the apexes on either side of the trailing edges of the one or more convex-shaped members to inject gas fuel so as to flow over those trailing edges.

25. The gas turbine combustor of claim 1 wherein said first row of convex-shaped members is positioned upstream from said second row of convex-shaped members, said first row of convex-shaped members including first spaced openings positioned adjacent the apex of at least some of said convex-shaped members of the first row, said first openings being adapted to be connected to a source of gas fuel, said second row of convex-shaped members including second spaced openings which are positioned adjacent the trailing edges of said second row of convex-shaped members and are adapted to be connected to a source of liquid fuel.

26. In a gas turbine combustor for mixing and combusting fuel and an oxidant comprising:

a combustor enclosure having an upstream mixing region adjacent one end region thereof, and a downstream combustion zone adjacent a remote end region thereof;

means for introducing an oxidant under pressure to said upstream mixing region to establish an oxidant flow toward said downstream combustion zone; and means for injecting a fuel in the upstream mixing region between said oxidant introducing means and said combustion zone;

said fuel injecting means including an upstream array of convex-shaped members and a downstream array of convex-shaped members extending substantially across said enclosure in planes transverse to said flow;

said convex-shaped members each including an apex connecting a pair of trailing edges, with the apexes of said convex-shaped members pointing toward the upstream end of said enclosure, and with the trailing edges of said convex-shaped members extending outward from said apexes toward said combustion zone;

the apexes of at least some of the downstream array of convex-shaped members being located behind said upstream array of convex-shaped members and pointed toward and proximate to spaces between adjacent trailing edges of adjacent convex-shaped members in said upstream array;

said fuel injecting means further including openings spaced along one or more of said convex-shaped members in a direction transverse to said flow;

whereby said upstream and downstream arrays of convex-shaped members are positioned to provide flow disturbance and prevent flame propagation to said mixing region from said combustion zone.

27. The gas turbine combustor of claim 26 wherein one or more fuel nozzles upstream from said convex-shaped members premix fuel with said oxidant flow, said fuel injecting means further comprising spaced openings in said one or more convex-shaped members in said upstream array and in said one or more convex-shaped members in said downstream array, to inject additional fuel to flow over the outside of the trailing edges of those convex-shaped members to mix with the premixed fuel.

28. The gas turbine combustor of claim 26 wherein at least one of said arrays of convex-shaped members is annular in shape and positioned about the axis of the combustor.

29. The gas turbine combustor of claim 28 wherein a plurality of said convex-shaped members are annular in shape and positioned about said axis of the combustor.

30. The gas turbine combustor of claim 26 wherein said fuel is gas fuel connected through a first manifold in some of said convex-shaped members in said upstream array for injection through first spaced openings into said oxidant flow in the region of said apexes.

31. The gas turbine combustor of claim 30 wherein liquid fuel is connected through a second manifold in some of said convex-shaped members in said downstream array for injection through second spaced openings into said oxidant flow in the region of the apexes of said downstream convex-shaped members.

32. The gas turbine combustor of claim 26 wherein said trailing edges of said convex-shaped members are at an angle to the axial flow of said fuel and oxidant, with the angle between the trailing edges of said downstream array of convex-shaped members being less than the angle between the trailing edges of said upstream array of convex-shaped members.

33. The gas turbine combustor of claim 32 wherein at least some of the fuel can be injected into said flow through openings in at least some of said convex-shaped members of said upstream array.

34. The gas turbine combustor of claim 26 wherein at least one of said arrays is canted with portions remote from the axis of said combustor being further downstream than portions closer to said axis.

35. The gas turbine combustor of claim 34 wherein both of said upstream and downstream arrays are canted.

36. The gas turbine combustor of claim 26 wherein said arrays of convex-shaped members include both annular and radial members positioned about the axis of the combustor.

37. The gas turbine combustor of claim 36 wherein said downstream array of convex-shaped members are V-shaped in cross section.

38. The gas turbine combustor of claim 37 wherein said upstream array of convex-shaped members are V-shaped in cross section.

39. The gas turbine combustor of claim 26 wherein the spaced openings in one or more of said convex-shaped members in said upstream array are adapted to be connected to a source of gas fuel, and the spaced openings in one or more of said convex-shaped members in said downstream array are adapted to be connected to a source of liquid fuel.

40. The gas turbine combustor of claim 39 wherein said one or more convex-shaped members in said upstream array connect said gas fuel for injection through said spaced openings in said upstream array to flow over the outside of the trailing edges of said members in said upstream array, and said one or more convex members in said downstream array connect said liquid fuel for injection through said spaced openings in said downstream array to flow into the region within and between the trailing edges of said members in said downstream array.

41. The gas turbine combustor of claim 40 wherein said upstream array of convex-shaped members and said downstream array of convex-shaped members are substantially parallel.

42. The gas turbine combustor of claim 26 wherein the spaced openings are located near said apexes of at least some of said convex-shaped members, and at least one fuel inlet is connected to said spaced openings for the admission of said fuel.

43. The gas turbine combustor of claim 42 further comprising a fuel nozzle to inject fuel upstream from said upstream array of convex members for premixing of fuel and oxidant.

44. The gas turbine combustor of claim 43 wherein said convex members include means to inject gas fuel into the premixed flow through first spaced openings located near the apexes of some of said convex members, and means to inject liquid fuel into said flow through second spaced openings located near the apexes of other of said convex members.

45. The gas turbine combustor of claim 44 wherein the apexes of the convex members are manifolds including at least one fuel passage to admit fuel into said manifolds, and all of said spaced openings are connected along said manifolds to inject fuel into said flow through all of said openings.

46. In a gas turbine combustor for mixing and combusting fuel and an oxidant comprising:

a combustor enclosure having an upstream mixing region adjacent one end region thereof, and a downstream combustion zone adjacent a remote end region thereof;

means for introducing an oxidant under pressure to said upstream mixing region to establish an oxidant flow toward said downstream combustion zone; and means for injecting a fuel in the upstream mixing region between said oxidant introducing means and said combustion zone;

said fuel injecting means including an upstream array and a downstream array of convex members extending substantially across said enclosure in planes transverse to said flow;

said convex members each including an apex connecting a pair of trailing edges, with the apexes of said convex members pointing toward the upstream end of said enclosure, and with the trailing edges of said convex members extending outward from said apexes toward said combustion zone;

the apexes of at least some of the downstream array of convex members being pointed toward and proximate to spaces between adjacent trailing edges of adjacent convex members in said upstream array;

said fuel injecting means further including openings spaced along one or more of said convex members in a direction transverse to said flow;

whereby said arrays of convex members are positioned to provide flow disturbance and prevent flame propagation to said mixing region from said combustion zone; and wherein a first manifold extends along the apexes of one or more of said convex members to connect a first manifold with a first fuel inlet adapted to be connected to a source of gas fuel which flows through said first manifold to the first group of spaced openings, and a second manifold extending adjacent said first manifold to connect a second group of openings spaced along said second manifold with a second fuel inlet adapted to be connected to a source of liquid fuel.

47. The gas turbine combustor of claim 46 wherein said first and second manifolds are on said upstream array of convex members.

48. The gas turbine combustor of claim 47 wherein said first manifold is positioned upstream from said second manifold.

49. The gas turbine combustor of claim 48 wherein said second group of spaced openings along said second manifold are between the trailing edges of the one or more convex members on which they are positioned to inject liquid fuel into the region within, and between, those trailing edges.

50. The gas turbine combustor of claim 49 wherein said first group of spaced openings along said first manifold lie to the outside of the trailing edges of the one or more convex members to inject gas fuel so as to flow over those trailing edges.

51. The gas turbine combustor of claim 50 wherein there are at least two rows of spaced openings extending across said first manifold, with one of the rows of openings located adjacent the outside surface of one of the trailing edges to inject the gas fuel to flow over the outside surface of said one of the trailing edges, and another of the rows of openings located adjacent the outside surface of the other of the trailing edges to inject the gas fuel to flow over the outside surface of said other of said trailing edges.

52. The gas turbine combustor of claim 51 wherein said first and second manifolds form a tube having a longitudinal wall extending transverse to said flow, and said tube is divided into two manifolds.

* * * * *